US005746500A

United States Patent [19]

Chien

[11] Patent Number: 5,746,500

[45] Date of Patent: May 5, 1998

[54] ILLUMINATED LACES FOR FOOTWEAR

[76] Inventor: Tseng-Lu Chien, 8F, No. 29, Alley 73, Lin-Shen Street, Shi-Chi Town, Taipei, Hseng, Taiwan

[21] Appl. No.: 738,555

[22] Filed: Oct. 28, 1996

[51] Int. Cl.[6] ..... F21L 15/08

[52] U.S. Cl. ..... 362/103; 362/800; 362/191; 36/137

[58] Field of Search ..... 362/103, 800, 362/806, 234, 190, 191, 189, 249, 184; 36/137; 2/245

[56] References Cited

U.S. PATENT DOCUMENTS

| | | | |
|---|---|---|---|
| 4,848,009 | 7/1989 | Rodgers | 362/103 |
| 4,935,851 | 6/1990 | Wood | 362/103 |
| 5,033,212 | 7/1991 | Evanyk | 362/103 |
| 5,052,131 | 10/1991 | Rondini | 36/137 |
| 5,294,312 | 3/1994 | Bland | 362/103 |
| 5,329,432 | 7/1994 | Bland | 362/103 |
| 5,371,662 | 12/1994 | Shen-Ko | 362/103 |
| 5,430,621 | 7/1995 | Raskas | 362/103 |
| 5,438,488 | 8/1995 | Dion | 36/137 |
| 5,456,032 | 10/1995 | Matsumoto et al. | 362/103 |
| 5,457,900 | 10/1995 | Roy | 36/137 |
| 5,465,197 | 11/1995 | Chien | 396/276 |

*Primary Examiner*—Thomas M. Sember
*Attorney, Agent, or Firm*—Bacon & Thomas

[57] ABSTRACT

An illuminated lace arrangement for footwear includes a conductive strip having affixed thereto a plurality of LEDs and electrical connections therefor, and textile netting material surrounding the strip. Electrical control components are housed in a power pack situated separately from the strip and netting material which forms the lace, or which includes a passage for permitting passage of the lace.

22 Claims, 8 Drawing Sheets

ILLUMINATED LACES FOR FOOTWEAR

BACKGROUND OF THE INVENTION

1. Field of the Invention

This invention relates to footwear, and in particular to footwear in which light emitting diodes (LEDs) are incorporated in the laces of the footwear.

2. Discussion of Related Art

Numerous lighting arrangements for footwear have been previously proposed or are currently being marketed. Such lighting arrangements enhance safety by increasing the visibility of the wearer while at the same time adding to the attractiveness of the footwear. For example, U.S. Pat. Nos. 4,848,009, 5,033,212, 5,329,432, 5,394,312, 5,371,662, 5,438,488, 5,456,032, and 5,457,900 all disclose LED lighting arrangements for footwear. Numerous older arrangements involving incandescent lights are also known.

Unlike the arrangements disclosed in the above-cited patents, the present invention concerns a specific type of footwear illumination arrangement, involving illumination of the laces of a shoe. Illumination of the laces is convenient because assembly of the illumination arrangement to the shoe is simplified, while allowing integration of the illumination arrangement into the overall shoe design to enhance marketability and avoid a retrofitted appearance.

However, illumination of the laces of the shoe presents three particular problems, namely distributing the light over the length of the laces for a bright appearance, preventing damage caused by bending of the laces, and fitting the illumination arrangement into the relatively small available space. While tubular or extended illumination arrangements for footwear other than lace illumination arrangements have also been previously proposed, the previous arrangements have disadvantages and/or are unsuitable for use as laces. For example, U.S. Pat. No. 5,052,131 provides a tube-shaped light arrangement for a sandal in which are situated a plurality of LEDs, but the power compartment is situated in the heel of the sandal, requiring a complicated and weak connection, and assembly and electrical connection of the lights within the tube is also relatively difficult. Alternatively, U.S. Pat. No. 5,502,903 discloses a linear side glow optical conduit and power pack/light source combination which can be affixed to the exterior of footwear to simplify assembly, but which lacks the appeal of an arrangement assembled with the shoe.

On the other hand, illuminated laces have previously been proposed in U.S. Pat. No. 5,430,621, in which an LED is used as the lighting source and the light from the LED is distributed along the length of the laces by using specially treated fiber-optic bundles. Because the light from the LED is distributed over the length of the laces, however, adequate brightness can be obtained only by using an enhanced brightness LED with an extended turn-on period. This increases the cost of the arrangement and decreases its life, including the life of batteries used as the power source, and consequently is impractical for mass-production and sales.

Another type of illuminated lace arrangement is disclosed in U.S. Pat. No. 4,935,851, in which an LED is provided at ends of a shoelace to light the lace. The use of single LEDs at the ends of the lace has the disadvantage of providing a limited viewing angle, and the electrical connection wires to the centrally positioned power pack are subject to twisting and damage when the laces are tied.

Finally, it has also been proposed, in copending application Ser. Nos. 08/611,049, filed Mar. 5, 1996, and 08/614, 001, filed Mar. 11, 1996, to use electro-luminescent lighting arrangements for shoelace illumination, but such arrangements have more complicated electrical requirements and involve higher cost lighting elements than conventional LED-based arrangements. In addition, use of electro-luminescent strips requires special over-tolerance bending prevention arrangements such as special eyelets or narrowing of the strips at turning points of the laces.

Thus, while numerous footwear illumination arrangements have previously been proposed, including arrangements used in laces, none provides a practical, inexpensive, and attractive lace illumination arrangement suitable for either original equipment or retrofitting applications, and which is both mass-producible and mass-marketable.

SUMMARY OF THE INVENTION

It is accordingly an objective the invention to provide an illumination arrangement for footwear laces that provides enhanced visibility, manufacturing convenience, useful life, and design flexibility in comparison with previously proposed lace illumination arrangements.

This objective of the invention is achieved, in accordance with several preferred embodiments of the invention, by providing a footwear illumination arrangement in which the illumination is provided by a transparent conductive strip, affixing super compact LEDs along the length of the strip so that they are visible on both sides of the strip, the strip providing flexibility while protecting the electrical connections to the LEDs, and inserting the strip thus constructed into a netting lace material.

In addition, the various preferred embodiments of the invention offer different power pack arrangements suitable for original installation upon assembly of the footwear (OEM) or for after-market applications.

The LEDs used in the preferred embodiments can be selected from a variety of types of conventional miniature LEDs, LED chips, or surface-mounted LED arrangements, or at least have a shape which facilitates mass-assembly. In addition, further advantages are obtained by including, in the power pack for the LEDs, either traditional low cost on/off switching circuitry or more sophisticated integrated circuits that can be used to control the LEDs to generate special effects such as flashing, steady on, fade in-fade out, chasing, and random lighting, or condition-sensitive switches such as the improved motion sensitive switch described in the Inventor's U.S. Pat. No. 5,465,197. The batteries may be arranged according to copending application Ser. No. 08/517,502, filed Aug. 21, 1995, and now U.S. Pat. No. 5,599,088, for an especially efficient and low cost power supply arrangement.

If an integrated circuit is used, multiple functions and a function selection device can be included. The power source can be in the form of conventional dry cell batteries such as button-type batteries, lithium batteries, 9V batteries, and so forth depending on the power pack design.

Footwear to which the principles of the invention may be applied include any type of footwear having laces or straps, including but not limited to athletic shoes, sandals, and skates. In addition, although the principles of the invention are especially suitable for application to laces and straps, it may be possible to extend those principles to any elongated footwear part, including purely or primarily decorative straps and piping.

BRIEF DESCRIPTION OF THE DRAWINGS

FIGS. 8, 8-1, 8-2, and 8-3 are plan views of LED and wiring arrangements for the LED strip used in the embodiments of FIGS. 1–4.

FIGS. 9, 9-1, and 9-2 are plan views illustrating some of the special effects obtainable with the circuitry of FIGS. 5–7.

FIGS. 10 and 10-1 illustrate the process of assembling a lace according to the principles of the invention.

DETAILED DESCRIPTION OF THE PREFERRED EMBODIMENTS

Figure 1:
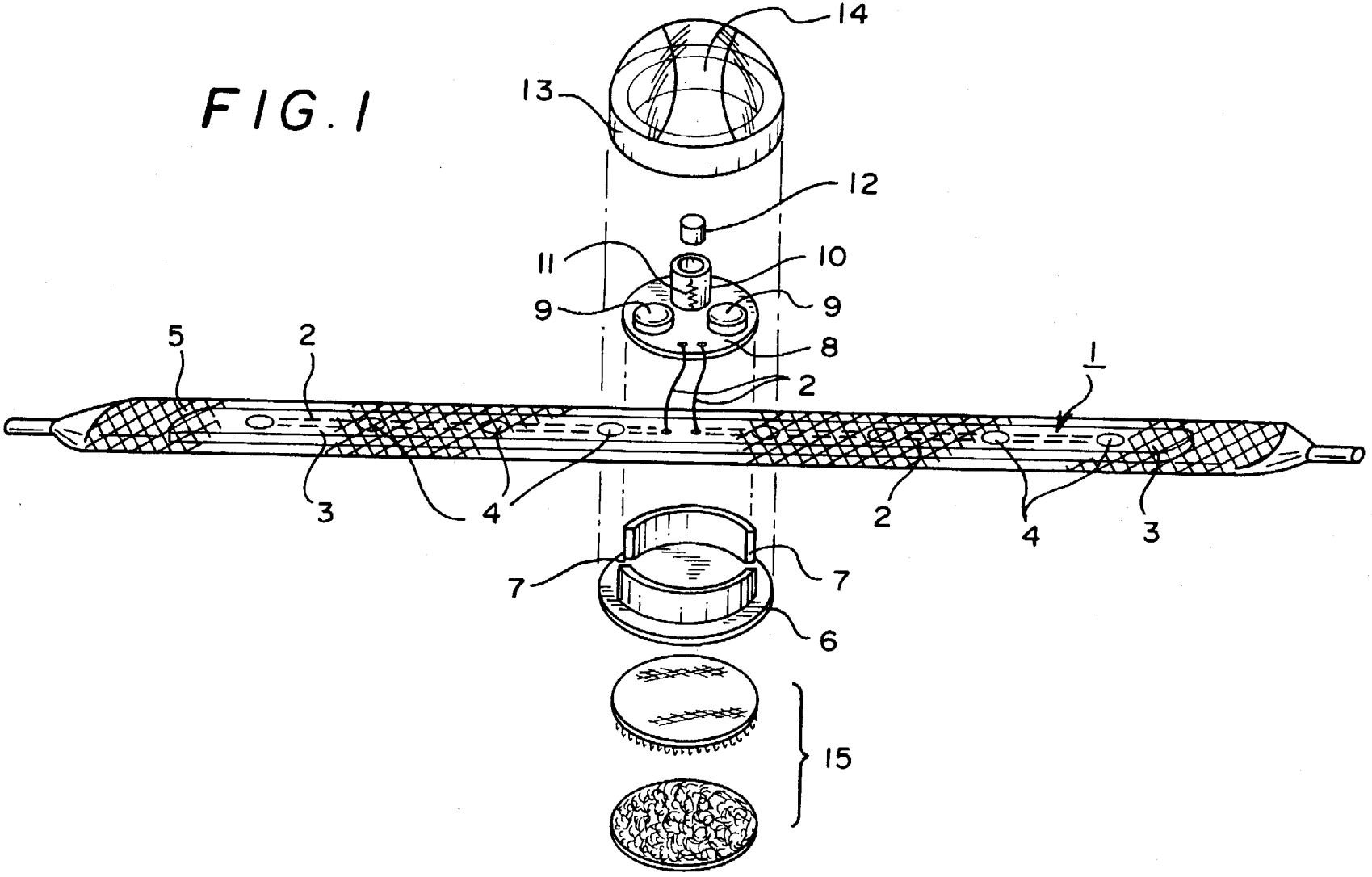
FIG. 1 is a perspective view of a footwear lace illumination arrangement constructed in accordance with the principles of a first preferred embodiment of the invention.

As illustrated in FIG. 1, the first preferred embodiment of the footwear illumination arrangement of the invention includes a flexible transparent conductive strip 1 made up of conductive members or means 2 having connected thereto a plurality of LEDs 4 sealed within a transparent material 3. To complete the lace, a textile material 5 surrounds the flexible transparent strip 1.

In this embodiment, the power supply for the LEDs 4 of flexible transparent strip 1 is housed within a power pack made up of a first housing member 6 having openings 7 to permit passage of the strip and a central recess for accommodating a circuit board 8 having traces (not shown) electrically connected to the conductive members or means 2 extending from the center of the strip through the netting material 5.

Circuit board 8 includes mounting structures for the batteries 9, and in the illustrated embodiment, a motion sensitive switch of the type disclosed in U.S. Pat. No. 5,465,197, herein incorporated by reference, made up of an outer conductive cylinder 10, a vibration responsive member 11, and an isolation straw 12. Circuit board also may include control circuitry (not shown in this figure).

The power supply housing of the first preferred embodiment of the invention is completed by a second housing member 13 having a dome cover 14 and means (not shown) for attaching the second housing member to the first housing member 6. Attachment means 15 are provided on the first housing member 6 and can take numerous different forms, including stitching, glue, or the illustrated Velcro™ arrangement.

Figure 2:
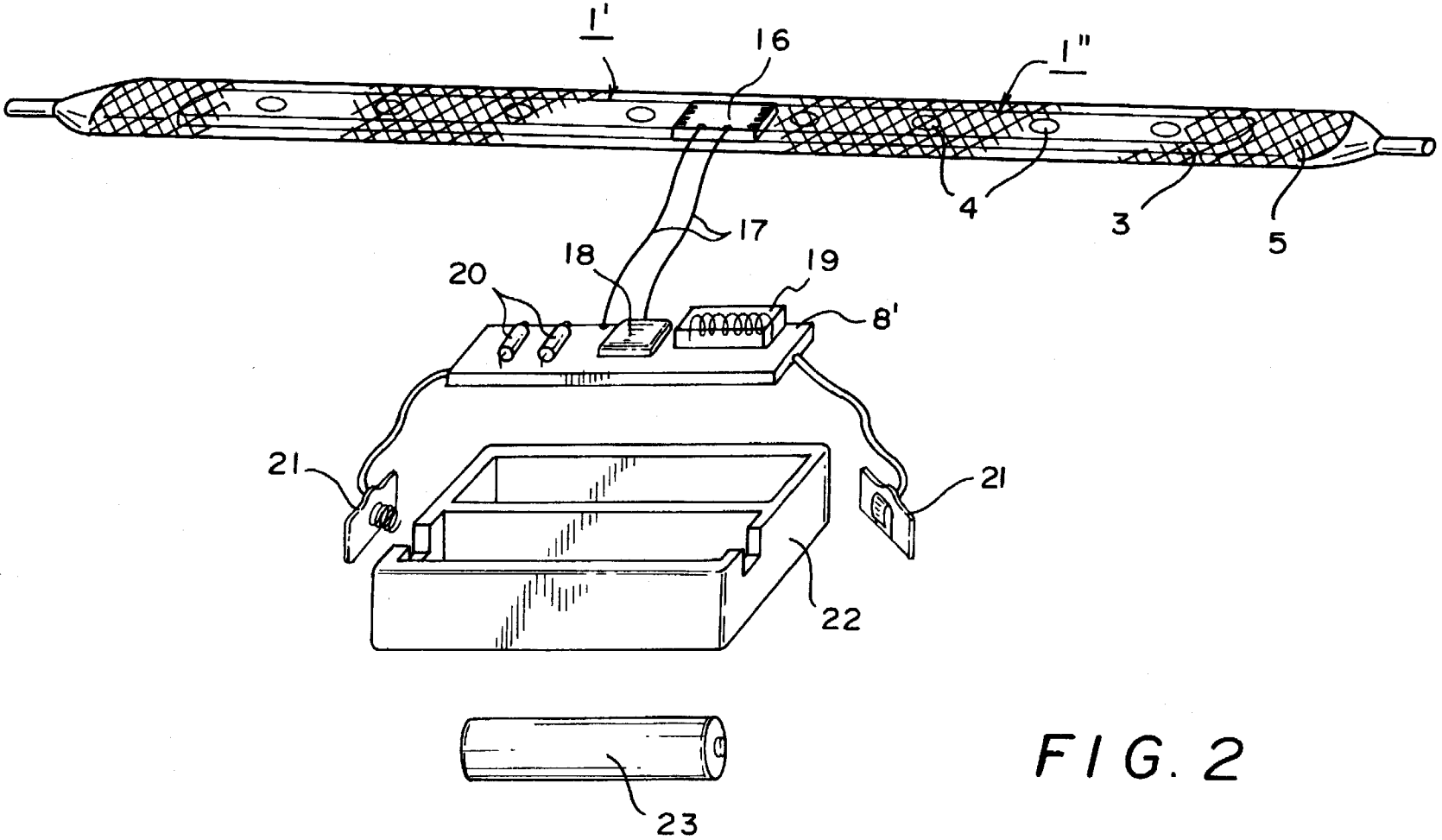
FIG. 2 is a perspective view of a footwear illumination arrangement constructed in accordance with the principles of the second preferred embodiment of the invention.

The embodiment of FIG. 2 is similar to that of FIG. 1, except that the strip 1 is replaced by two strips 1' and 1" connected by a small connection board 16 for providing electrical connections between the respective conductive members or means within the strips and wires 17 to the main circuit board 8', on which is mounted an integrated circuit controller 18, a directional motion sensor 19, electrical components 20 (schematically represented), and optional battery terminals 21. In this embodiment, the power supply housing takes the form of a unit 22 having one compartment for the circuit board 8' and another for the battery 23, which instead of a button cell as in the first embodiment is a conventional dry cell or lithium battery. Unit 22 of this embodiment is suitable for positioning in a the outsole of a shoe, or in the hollow of the heel, whether the outsole or heel is a separate unit or not.

It will of course be appreciated by those skilled in the art that neither of the above two embodiments is intended to be limiting in nature, and that features of one embodiment, such as the use of an integrated circuit controller in the second embodiment, or the mounting of the power supply in a shoe outsole or heel, may be freely used in connection with all or some of the structures shown in connection with the other embodiments of the invention.

Figure 3:
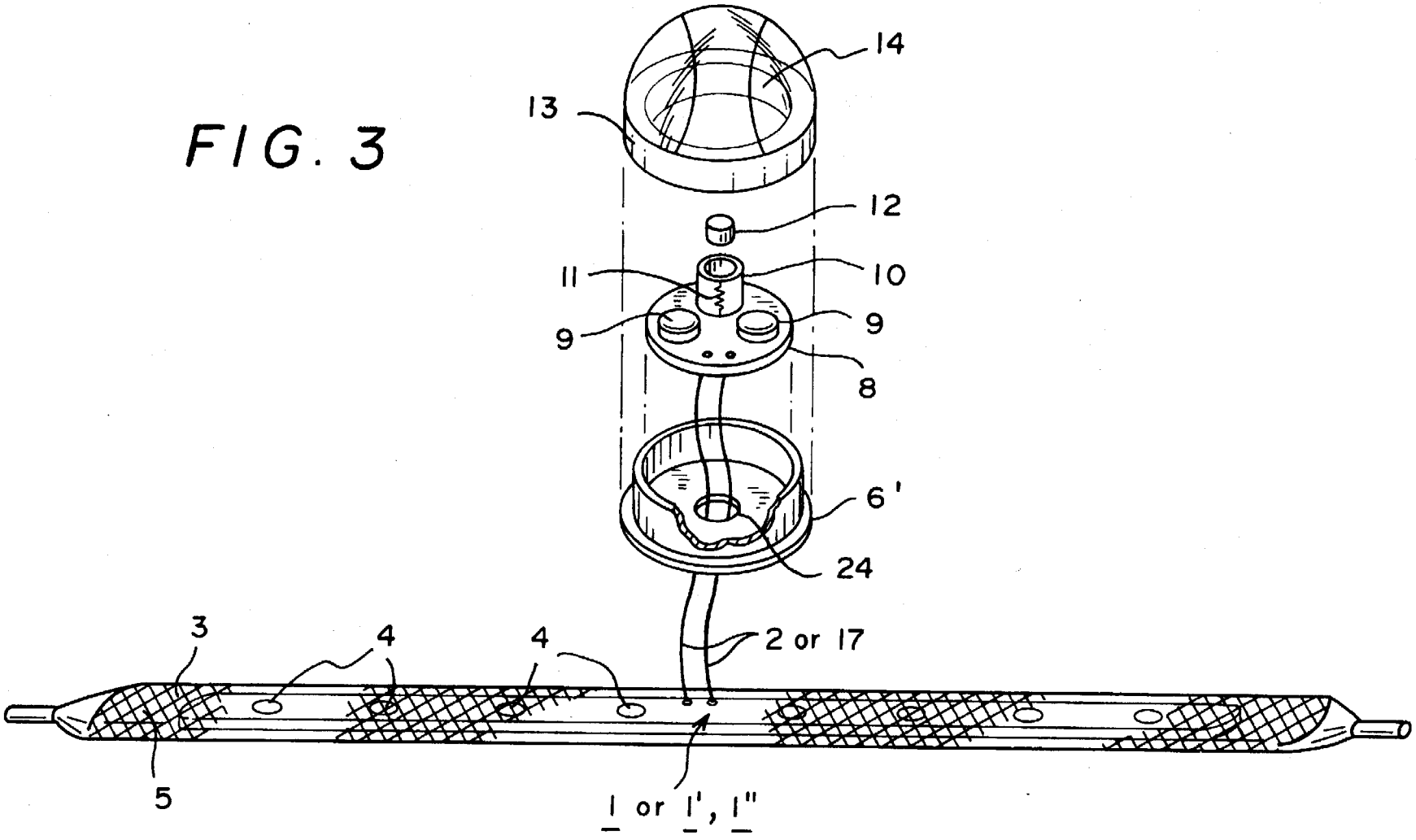
FIG. 3 is a perspective view of a footwear illumination arrangement constructed in accordance with the principles of a third preferred embodiment of the invention.
Figure 4:
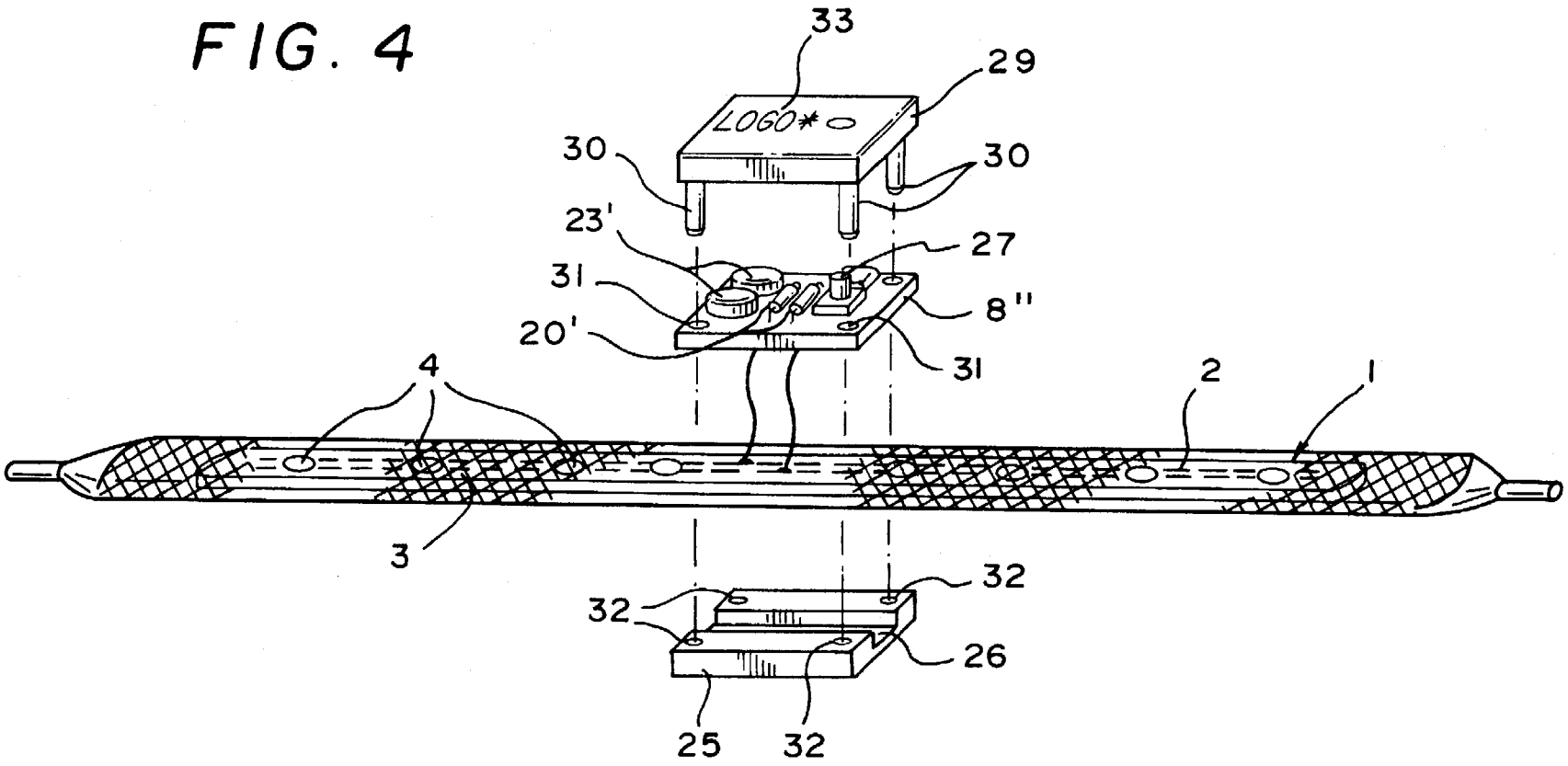
FIG. 4 is a perspective view of a footwear illumination arrangement constructed in accordance with the principles of a fourth preferred embodiment of the invention.
Figure 7:
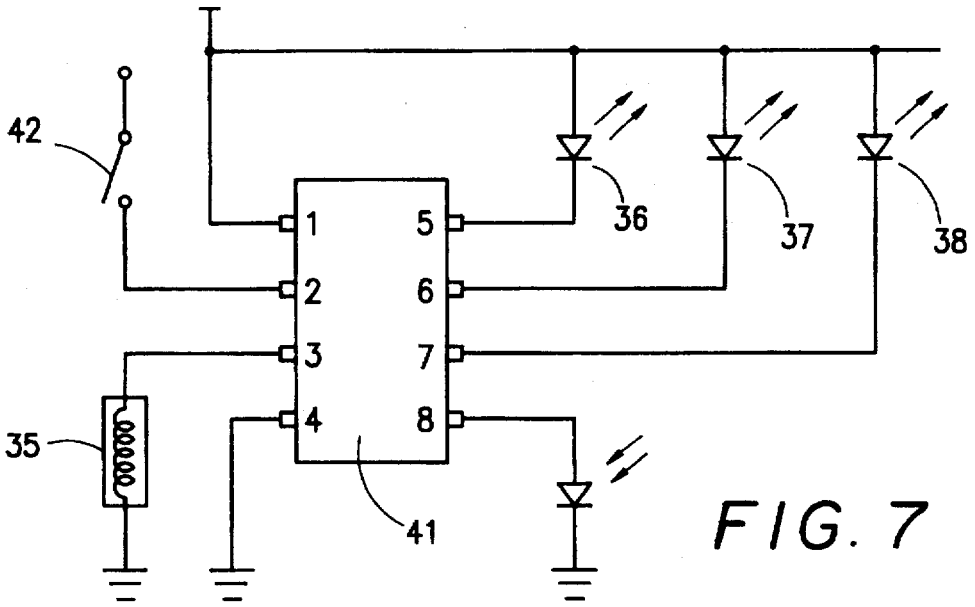
FIGS. 7 is a schematic circuit diagram of a multiple function integrated circuit and selector switch arrangement which can also be used with any of the embodiments of FIGS. 1–4.

For example, the embodiment illustrated in FIG. 3 uses the lace structure of FIG. 1 in combination with a separate housing similar to that of FIG. 1, but without the openings for accommodating the lace, the lower housing 6' instead including an opening 24 for permitting passage of wires so that the housing can be mounted elsewhere on the footwear as in the embodiment of FIG. 3, for example inside layers of or on the tongue of the footwear, or elsewhere on the upper surface of the shoe, and can be either exposed or hidden. Similarly, the embodiment of FIG. 4 can use either a one-piece or two-piece strip 1/1',1", a housing in which a lower housing portion 25 includes an opening 26 for accommodating the lace, and a circuit board 8" having arranged thereon button cell batteries 23', circuit components 20', and a push button on/off switch 27, while the upper portion 29 includes posts 30 for providing a snap-fit connection with corresponding openings 31 and 32 in the circuit board 8" and lower housing portion 25, thereby permitting easy battery replacement. Numerous other versions of the illustrated power supply housing can undoubtedly be imagined by those skilled in the art and the present invention is intended to cover all such variations, including variations in the shape and decoration of the housing (for example printing of a trademark or logo 33), and in the location of the housing on the footwear and the means for attaching the housing to the footwear.

In each of the illustrated embodiments of the invention, the distribution of LEDs along the length of flexible transparent strip 1 permits the entire lace to be brightly illuminated without using complicated wiring devices or specifically treated modules, and with low power consumption. However, it will also be appreciated by those skilled in the art that the LEDs need not be equally distributed along the strip, and that the LEDs can instead be located anywhere on the strip. In addition, the strip can be made of one or more sections, the LEDs can be arranged in more than one layer or on more than one side of the strip, and the construction of the transparent material layer 3 can be varied without departing from the scope of the invention, including variation in dimensions.

Typical thicknesses of the strip 1 are between 0.05 mm and 1.0 mm depending on the requirements of the application in which the strip is used, with the width ranging from 1 mm to 10 mm, and less than 6 mm for the most popular laces. Preferably, the strip 1 is shorter than the netting material 5 placed around the strip so as to provide freedom of movement of the strip within the lace material and thereby prevent the strip from being directly pulled by the user when tying the laces. Also, strip 1 may have rounded ends to facilitate insertion of the strip into the netting material 5. The preferred length of the strip is around 15 cm (6") from the center of the textile netting material, although laces can range from 25 cm (10") for boots and hightop athletic shoes to less than 10 cm (4") for baby footwear. It will be appreciated by those skilled in the art that the various parts of the lace are not drawn to scale.

The conductive members or means 2 by which the LEDs are connected to a power supply can be in the form of wires, strips, ribbons, or conductive materials printed onto or sealed inside of the transparent layer by, for example, silk-screening, while the transparent material 3 within which the conductive members or means 2 are sealed can be PVC, Mylar™, or a similar plastic material. Although not shown, connectors and wiring harness of various types can be used with the preferred embodiments, particularly in applications wherein the power supply housing is situated away from the lace, such as in the outsole of a shoe. Use of prearranged connectors can greatly simplify the manufacturing process.

The number of conductive members can be limited to two for a basic parallel connection of the LEDs to be connected thereto, in order to obtain steady state, fade in-fade out, or collective flashing effects, or up to N+1 wires where N is the number of LEDs and each LED is connected between a common wire and a separate wire in order to provide for independent control of the LEDs and thereby obtain any variety of effects, particularly if controlled by an integrated circuit controller as described below. FIG. 8 shows an arrangement of N+1 wires while FIGS. 8-1, 8-2, and 8-3 show simple parallel connections for different size LEDs, with FIGS. 8, 8-1, and 8-2 showing strips having electrical terminals at one end, an FIG. 8-3 showing an arrangement in which the conductive arrangement 2*a* connects an arbitrary number of LEDs and is connected by wires 2*b* to the power pack.

As also shown in FIG. 8-2, the transparent conductive strip 1 can be made of an opaque material 39 with cut-outs or transparent areas 38 bridged by the LEDs to permit the LEDs to be visible from both sides of the strip and yet save the cost of the transparent material. Visibility in this alternative can also be enhanced by using an epoxy material to provide optical effects such as image magnification.

The plurality of LEDs 4 must have a size small enough to fit within the parameters of the strip 1 and can be selected from a number of different LEDs commercially available from such vendors as Toshiba of Japan in a variety of colors, including green, yellow, red, and so forth. For example, surface mounted kits 4' and 4", as illustrated respectively in FIGS. 8-1 and 8-2, are available having sizes of around 2.4 mm×2.8 mm (oval) or 1.9 mm×2.1 mm (rectangular), or in the form of LED chips made up of several elements having dimensions of 280 μm×280 μm (11 mil×11 mil) with emission areas of 250 μm ×250 μm (10 mil×10 mil) and which can be affixed to the strip by machine to save labor. Conventional LEDs having a diameter of 3 mm to 5 mm, or other sizes of LEDs, could also be used for some applications, and each strip can have one or multiples types of LEDs in one or more colors.

Advantageously, the plurality of LEDs of the illustrated embodiment may be chemically sealed by epoxy or the like to form lens-like optical elements to enlarge the viewing area or form a masking device to make larger bright spots on the transparent conductive strip on both sides.

In each of the illustrated embodiments, on/off control can be provided by a manual switch, automatic switches such as vibration or temperature-responsive, inertial switches, or photo-switches, and/or combinations of different switches, and analog or digital control circuitry with a selector switch can be added for obtaining special multiple element lighting effects, including chasing, fade in/out, random flashing, sequential flashing, or combinations of the above effects all in one unitary circuit.

Figure 6:
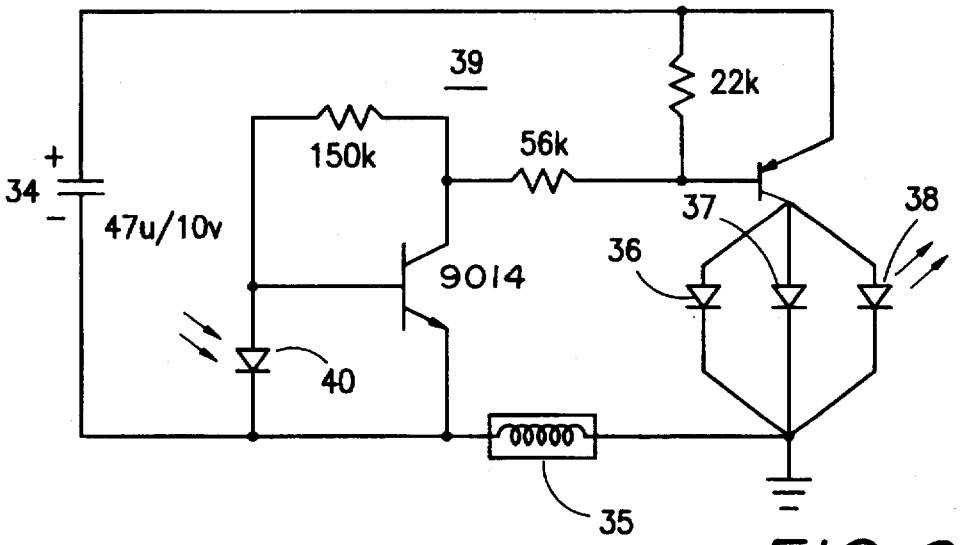
FIG. 6 is a schematic circuit diagram of a circuit providing fade-in, fade-out effects for use with any of the embodiments of FIGS. 1–4.
Figure 5:
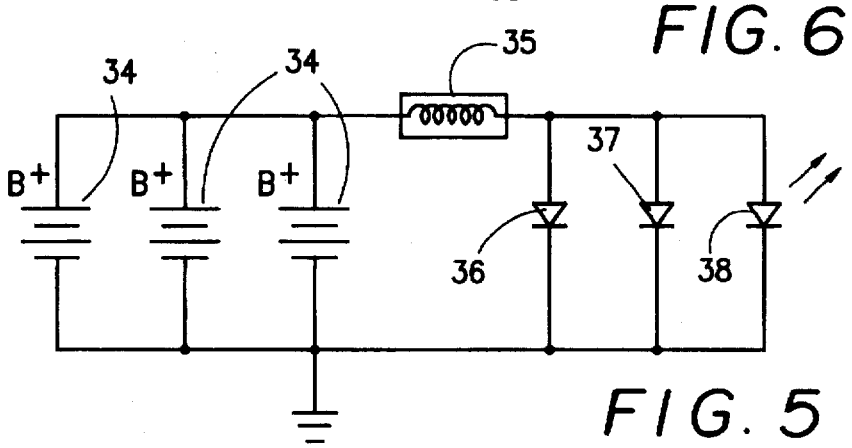
FIG. 5 is a schematic circuit diagram of a basic circuit which can be used with any of the embodiments of FIGS. 1–4.
Figure 8A:
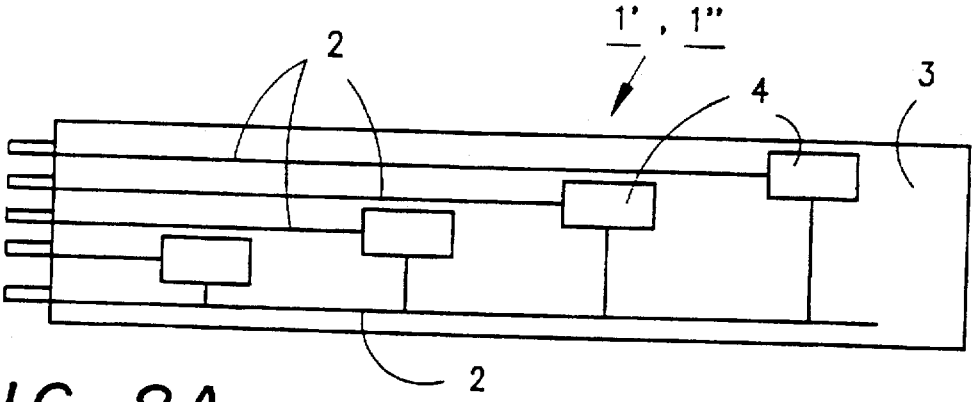
Figure 8B:
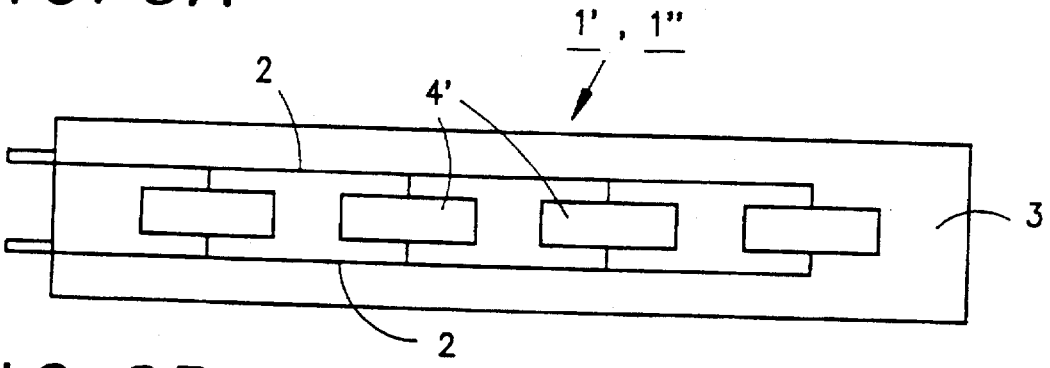
Figure 8C:
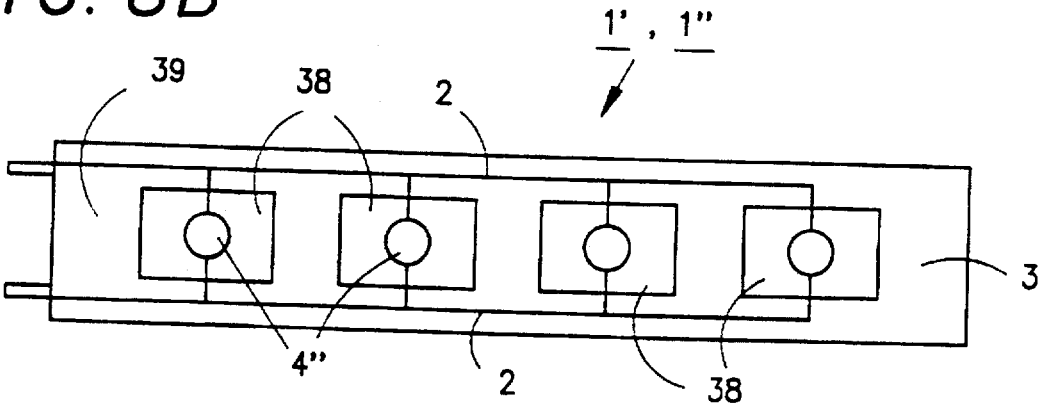
Figure 8D:
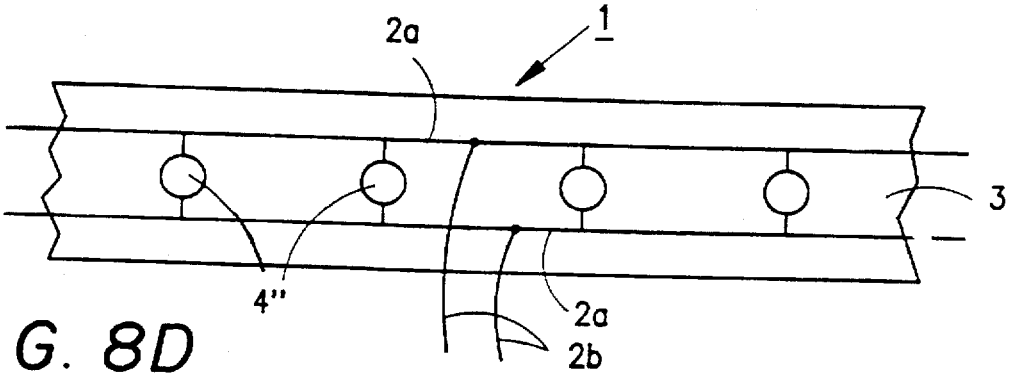
Figure 9A:
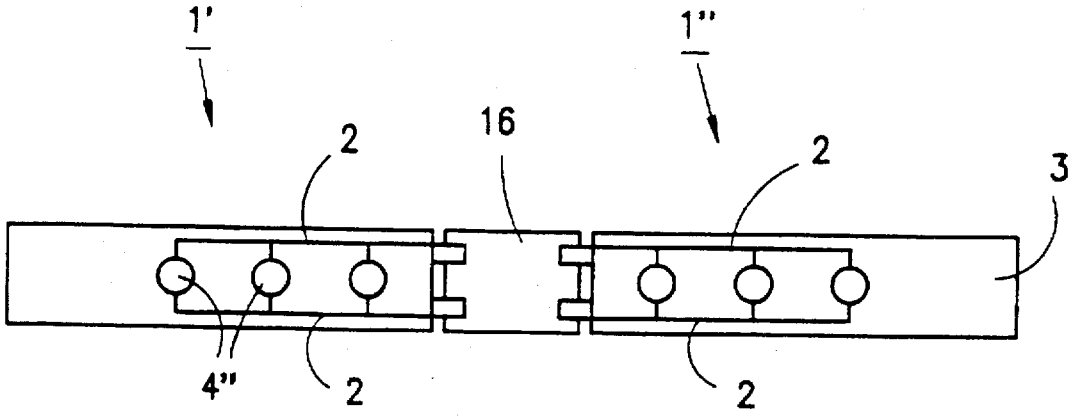
Figure 9B:
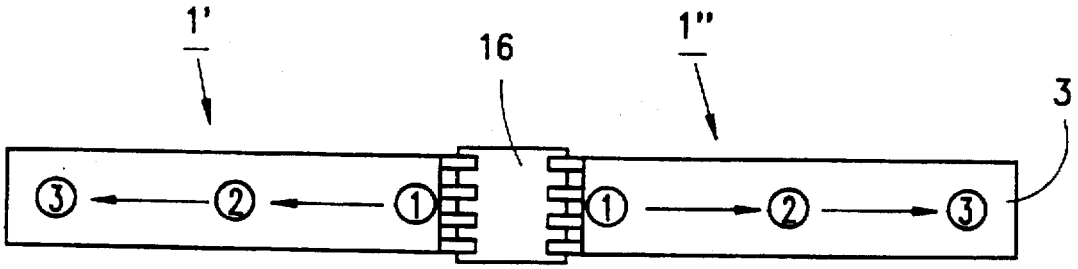
Figure 9C:
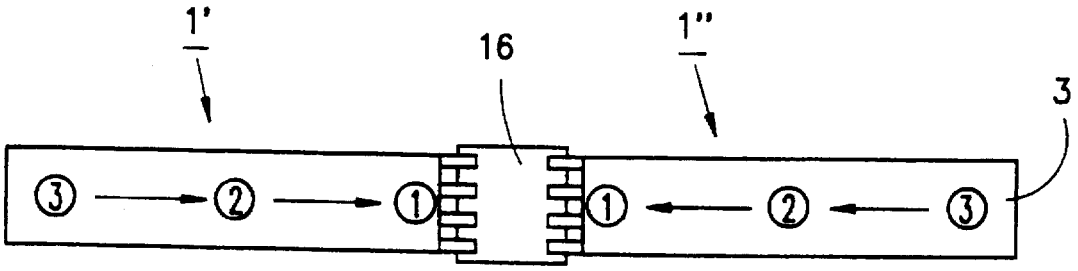

As illustrated in FIG. 5, for example, the control circuitry can be as simple as a battery 34, a motion sensitive switch 35, and LEDs 36-38 or, as illustrated in FIG. 6, the control circuit can include a fade-in, fade-out circuit 39, which optionally may be activated by a photodiode 40 in addition to the battery 34 and switch 35. Alternatively, the LEDs 36-38 (and additional LEDs not shown) can be individually controlled by an integrated circuit 41 and function select switch 42. The control circuits of FIGS. 5 and 6 only require two wires to connect all of the LEDs in parallel, as illustrated in FIGS. 9, whereas separate connections are required to achieve random effects or chasing effects such as are indicated by the arrows from 1 to 3 in FIGS. 9-1 and 9-2. Those skilled in the art will appreciate that there are numerous available analog and digital circuits for providing different light activation functions to achieve any of a variety of special lighting effects, and that the switch can be mechanical or electrical and responsive to conditions such as temperature, moisture, tilt, vibration, and ambient light level.

Figure 10:
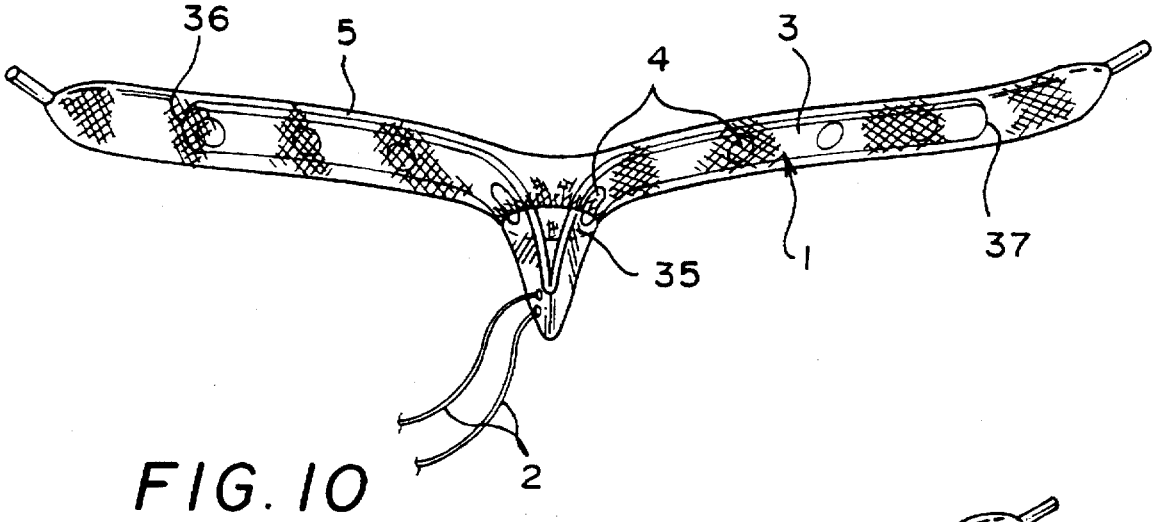
Figure 10A:
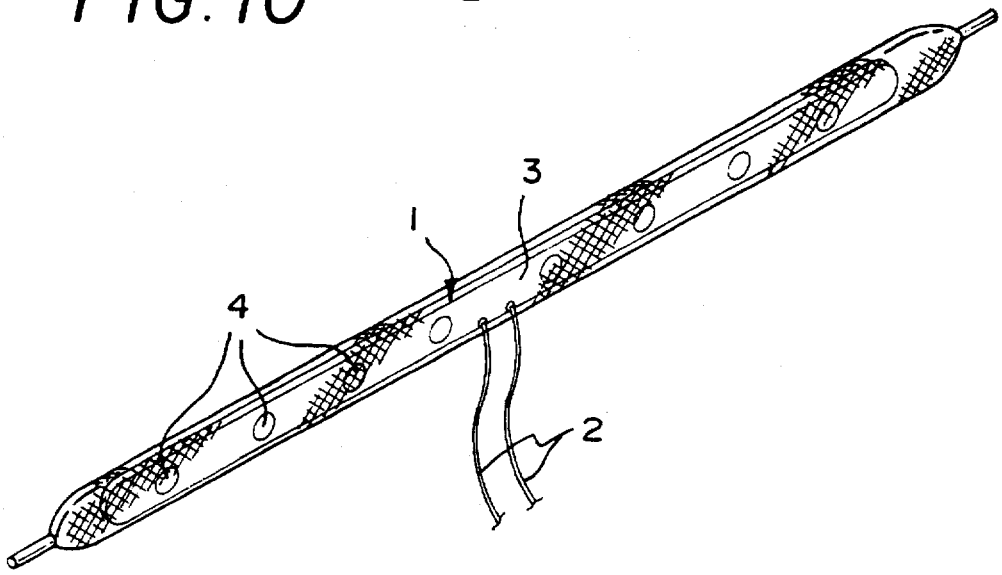

As illustrated in FIG. 10, the preferred method of placing the plurality of LEDs 4 and conductive strip 1 inside the textile netting lace involves making a hole 35 in the center of the lace by a tool to push the open weave textile material aside so as to allow the two preferably rounded ends 36 and 37 of the transparent conductive strip 1 (or strips 1' and 1" ) to be inserted into the hole and pushed towards the ends of the lace, after which the lace material can be pushed back into place to eliminate the hole and provide a completed lace as illustrated in FIG. 10-1. This preserves the integrity and appearance of the lace.

Having thus described several different preferred embodiments of the invention, as well as a number of different implementations of the preferred embodiments, those skilled in the art will appreciate that numerous variations and modifications of the preferred embodiments and implementations thereof may nevertheless be made without departing from the scope of the invention. It is accordingly intended that the invention not be limited by the above description or accompanying drawings, but that it be defined solely in accordance with the appended claims.

We claim:

1. An illuminated lace arrangement for footwear, comprising:

at least one flexible strip, said strip being at least partially transparent and having affixed thereon a plurality of light emitting diodes visible from two sides of the strip and conductive means for supplying electrical power to the light emitting diodes;

a textile lace material having inserted therein said strip;

a power pack including means for affixing the power pack at a desired location on the footwear;

electrical circuit means positioned in said power pack and connected to said conductive means in said strip for causing said LEDs to turn on and off to provide a desired light performance.

2. An illuminated lace arrangement as claimed in claim 1, wherein the power pack is located on said footwear at a position remote from the lace material.

3. An illuminated lace arrangement as claimed in claim 1, wherein the power pack is located on an upper surface of the footwear.

4. An illuminated lace arrangement as claimed in claim 3, wherein the power pack is exposed to a viewer.

5. An illuminated lace arrangement as claimed in claim 3, wherein the power pack is concealed within layer of a tongue of the footwear.

6. An illuminated lace arrangement as claimed in claim 1, wherein the power pack is situated in a hollow space within an outsole of the footwear.

7. An illuminated lace arrangement as claimed in claim 1, wherein the power pack is situated in a hollow space within a heel of the footwear.

8. An illuminated lace arrangement as claimed in claim 1, wherein the power pack includes means for permitting passage of the strip and textile lace material, said means including openings in a housing of the power pack.

9. An illuminated lace arrangement as claimed 1, wherein the power pack includes a replaceable cover to permit battery replacement.

10. An illuminated lace arrangement as claimed in claim 1, wherein the conductive means comprises elements selected from the group consisting of wires, printed conductive materials, and conductive ribbons situated on the strip.

11. An illuminated lace arrangement as claimed in claim 1, wherein the power pack includes a plurality of batteries.

12. An illuminated lace arrangement as claimed in claim 1, wherein said conductive means includes two terminals and said LEDs are connected in parallel.

13. An illuminated lace arrangement as claimed in claim 1, wherein said conductive means includes more than two terminals and at least some of said LEDs are arranged to be separately switched on and off by said electrical circuit means.

14. An illuminated lace arrangement as claimed in claim 1, wherein said electrical circuit means is an analog circuit.

15. An illuminated lace arrangement as claimed in claim 1, wherein said electrical circuit means includes an integrated circuit and a selector switch for selecting from a plurality of light performance functions.

16. An illuminated lace arrangement as claimed in claim 1, wherein the LEDs are treated with means for optically enhancing a visibility of the LEDs.

17. An illuminated lace arrangement as claimed in claim 1, wherein the switch is a condition responsive switch responsive to a condition selected from the group consisting of temperature, moisture, tilt, vibration, and ambient light level.

18. An illuminated lace arrangement as claimed in claim 1, wherein the strip is a single piece having a desired length.

19. An illuminated lace arrangement as claimed in claim 18, wherein a length of the strip is less than a length of the textile lace material.

20. An illuminated lace arrangement as claimed in claim 1, wherein the strip includes generally opaque areas and transparent areas formed between the opaque areas, said LEDs being situated in the transparent areas so as to be visible from two sides of the strip.

21. An illuminated lace arrangement as claimed in claim 1, wherein the strip includes generally opaque areas and cut-outs formed in the opaque areas, said LEDs being situated in the cut-outs so as to be visible from two sides of the strip.

22. An illuminated lace arrangement as claimed in claim 1, wherein said light performance is selected from the group consisting of flashing, random, steady-on, fade in-fade out, chasing, and sequential effects.

* * * * *